US008362981B2

(12) United States Patent
Mizukoshi et al.

(10) Patent No.: US 8,362,981 B2
(45) Date of Patent: Jan. 29, 2013

(54) DISPLAY DEVICE

(75) Inventors: Seiichi Mizukoshi, Tokyo (JP); Makoto Kohno, Tokyo (JP)

(73) Assignee: Global OLED Technology LLC, Herndon, VA (US)

( * ) Notice: Subject to any disclaimer, the term of this patent is extended or adjusted under 35 U.S.C. 154(b) by 169 days.

(21) Appl. No.: 13/020,556

(22) Filed: Feb. 3, 2011

(65) Prior Publication Data

US 2012/0026082 A1 Feb. 2, 2012

(30) Foreign Application Priority Data

Feb. 4, 2010 (JP) ..... 2010-023288

(51) Int. Cl.
*G09G 3/30* (2006.01)

(52) U.S. Cl. ..... 345/76; 345/694; 315/169.3; 340/5.91

(58) Field of Classification Search ..... 345/76, 345/77, 474, 690, 694; 705/14.37, 14.4; 715/706; 315/169.3; 340/5.91; 330/500
See application file for complete search history.

(56) References Cited

U.S. PATENT DOCUMENTS 7,185,281 B2 * 2/2007 Farago et al. ..... 715/700
2008/0297448 A1 12/2008 Mizukoshi et al.

FOREIGN PATENT DOCUMENTS

JP 2006-003475 1/2006

* cited by examiner

*Primary Examiner* — Abbas Abdulselam
(74) *Attorney, Agent, or Firm* — Morgan, Lewis & Bockius LLP

(57) ABSTRACT

In order to maintain a high visual image quality and save power, a display device includes: R sub-pixels, G sub-pixels, B sub-pixels, and W sub-pixels; and a human detection sensor (12) for detecting whether or not a person is present within a predetermined range. A use rate of the W sub-pixels is changed depending on whether or not a person is present within the predetermined range.

3 Claims, 13 Drawing Sheets

DISPLAY DEVICE

The present invention claims the benefit of Japanese Patent Application No. 2010-23288, filed in Japan on Feb. 4, 2010, which is hereby incorporated by reference.

BACKGROUND OF THE INVENTION

1. Field of the Invention

The present invention relates to a display device including R, G, B, and W sub-pixels, and more particularly, to determining a use rate of the W sub-pixel.

2. Description of the Related Art

FIG. 1 illustrates an example of a typical dot arrangement of a matrix type organic electroluminescence (EL) panel 1 in which three sub-pixels 3 of red (R), green (G), and blue (B) constitute one pixel 2. FIGS. 2 and 3 illustrate examples of a dot arrangement of a matrix type organic EL panel 1 which uses sub-pixels 3 including white (W) in addition to R, G, and B. In FIG. 2, sub-pixels 3 are arranged in a horizontal direction to form one pixel 2. In FIG. 3, sub-pixels 3 are arranged in 2×2 matrix to form one pixel 2. The RGBW type organic EL panel 1 uses the W sub-pixel, which is higher in emission efficiency than R, G, and B sub-pixels, in order to reduce power consumption and increase luminance of the panel. Methods for realizing the RGBW type panel include a method involving using organic EL elements emitting respective colors of the sub-pixels, and a method involving overlaying red, green, and blue optical filters on white organic EL elements to realize the sub-pixels other than the W sub-pixel.

FIG. 4 is a CIE 1931 chromaticity diagram illustrating an example of a chromaticity of white (W) used for the white pixel in addition to the three typical primary colors of red (R), green (G), and blue (B). Note that, the chromaticity of W does not necessarily need to match reference white of the display.

FIG. 5 illustrates a method of converting R, G, and B input signals, with which the reference white of the display may be displayed when R=1, G=1, and B=1, to R, G, B, and W image signals. First, if the emission color of the W sub-pixel does not match the reference white of the display, the following operation is performed on the input RGB signals for normalization to the emission color of the W sub-pixel.

Equation 1

$$\begin{bmatrix} Rn \\ Gn \\ Bn \end{bmatrix} = \begin{bmatrix} a & 0 & 0 \\ 0 & b & 0 \\ 0 & 0 & c \end{bmatrix} \times \begin{bmatrix} R \\ G \\ B \end{bmatrix} \quad \text{[Num. 1]}$$

where R, G, and B are input signals, Rn, Gn, and Bn are normalized red, green, and blue signals, and a, b, and c are coefficients selected so that a luminance and a chromaticity equivalent to those obtained when W=1 are obtained when R=1/a, G=1/b, and B=1/c.

Examples of the most fundamental operational expressions for S, F2, and F3 include:

$$S=\min(Rn,Gn,Bn) \quad \text{Equation 2}$$

$$F2(S)=-S \quad \text{Equation 3}$$

$$F3(S)=S \quad \text{Equation 4}$$

In this case, as the color of the displayed pixel is more achromatic, the ratio at which the W sub-pixel is lit increases. Therefore, as the ratio of near-achromatic colors in a displayed image increases, the power consumption of the panel becomes lower as compared to the case where only R, G, and B sub-pixels are used.

The final normalization to the reference white is, similarly to the normalization to the emission color of the W sub-pixel, processing performed when the emission color of the W sub-pixel does not match the reference white of the display, and involves performing the following operation:

Equation 5

$$\begin{bmatrix} R' \\ G' \\ B' \end{bmatrix} = \begin{bmatrix} 1/a & 0 & 0 \\ 0 & 1/b & 0 \\ 0 & 0 & 1/c \end{bmatrix} \times \begin{bmatrix} Rn' \\ Gn' \\ Bn' \end{bmatrix} \quad \text{[Num. 2]}$$

In general, few images are constituted only of pure colors, and the W sub-pixel is used in most cases. Therefore, the overall power consumption is reduced in average as compared to the case where only R, G, and B sub-pixels are used.

In a case where the following equations are used for F2 and F3, the use rate of the W sub-pixel changes depending on the value of M.

$$F2(S)=-MS \quad \text{Equation 6}$$

$$F3(S)=MS \quad \text{Equation 7}$$

where M is a constant in the range of

In view of power consumption, it is most preferred to use M=1 as expressed by Equations 2 to 4, that is, the use rate of 100%. However, in view of visual resolution, it is preferred to select such a value of M that all the R, G, B, and W sub-pixels are lit where possible. This is described below in detail.

In a panel in which R, G, and B sub-pixels are arranged in matrix as illustrated in FIG. 1, in order to improve the visual resolution, a phase of a signal of each color and the position of each sub-pixel in the panel are aligned as illustrated in FIG. 6. In this case, the resolution in the horizontal direction of the input image signal is three times the number of horizontal pixels of the panel, and hence needs to be the same as the number of sub-pixels in the horizontal direction of the panel. However, when sampling is performed for each color at timings as illustrated in FIG. 6, the apparent resolution increases. In other words, when the phase of each color signal and the position of each sub-pixel are aligned, it is possible to obtain a display image which is higher in apparent resolution than that obtained in a case where three sub-pixels of R, G, and B are all driven with signal data of the same phase (FIG. 7). This is because luminance information at the position of each sub-pixel of the input signal may be reproduced to some extent by the luminance component of each color.

Also in the case where R, G, B, and W sub-pixels are used as illustrated in FIGS. 2 and 3, it is possible to increase the apparent resolution in a similar manner by aligning the phase of each color signal and the position of each sub-pixel of the panel. FIG. 8 illustrates an example of sampling when the use rate of the W sub-pixel is approximately 50% in the case where the sub-pixels are arranged as illustrated in FIG. 2.

When the use rate of the W sub-pixel is 100%, that is, in a case where M=1 in Equations 6 and 7, as the image becomes more achromatic, the effect becomes lower because the amount of light emitted by the R, G, and B sub-pixels becomes smaller. In particular, in the case where the primary W color is identical to the reference white, R, G, and B sub-pixels are not used at all when a black and white image is displayed, with the result that the resolution is the same as the number of W sub-pixels as illustrated in FIG. 9.

As described above, the power consumption and the apparent resolution change depending on the value of M and are in a trade-off relation. Therefore, in Japanese Patent Application Laid-open No. 2006-003475, spatial frequency components of a displayed image are partially detected, and the use rate (M) of the W sub-pixel is adaptively changed depending on the detection result, to thereby suppress reduction in resolution and reduce power consumption.

According to the method of Japanese Patent Application Laid-open No. 2006-003475, an average power consumption considerably close to that obtained when M=1 may be obtained depending on the picture, and at the same time, the value of M may be decreased at edge portions of the image to improve the image quality. However, even with this method, the image quality at portions that are near-achromatic and low in spatial frequency may appear poorer than that in a case where M is constant and optimized for the image quality. Specifically, M becomes large at the portions so that only the W sub-pixels are brightly lit to be seen as stripes in the case of the arrangement of FIG. 2 and as dots in the case of the arrangement of FIG. 3 from a close distance.

A person with a visual acuity of 1.0 has a resolution of 1 arc minute of visual angle, and it is said that, if the number of scanning lines is 1,100, the scanning lines are invisible when the viewing distance is 3H (3 times the height of screen) or more. Therefore, when viewed from a predetermined distance or more, there is no problem in image quality even when M=1 in the case of the display device including square pixels as illustrated in FIGS. 2 and 3. As described above, in the case of the display device in which one pixel is constituted of a plurality of sub-pixels, it is desired that the image be viewed from such a distance that each sub-pixel cannot be distinguished. However, it is difficult to always satisfy this condition, because the size of the sub-pixel varies depending on specifications of the number of pixels, the screen size, and the like, and because the distance between the display device and the viewer changes depending on the use environment.

Further, in applications such as digital signage, there may be cases where, although people are usually located away from the display device, one of the people who felt interest in the content of the digital signage may approach the digital signage to take a close look at the content.

SUMMARY OF THE INVENTION

According to the present invention, there is provided a display device, including: pixels arranged in matrix, the pixels each including an R sub-pixel, a G sub-pixel, a B sub-pixel, and a W sub-pixel; and a human detection sensor for detecting a person around the display device, in which a use rate of the W sub-pixel is changed depending on a result of the detection.

Further, it is preferred that the human detection sensor be a sensor for detecting whether or not a person is present within a predetermined range from the display device, and that the display device change the use rate of the W sub-pixel depending on whether or not a person is present within the predetermined range.

Further, it is preferred that the human detection sensor be a sensor for measuring a distance of a person located closest to the display device, and that the display device change the use rate of the W sub-pixel depending on the measured distance.

According to the present invention, a high visual image quality is maintained while saving power.

DETAILED DESCRIPTION OF THE PREFERRED EMBODIMENT

Hereinafter, an embodiment of the present invention is described with reference to the accompanying drawings.

Figure 1:
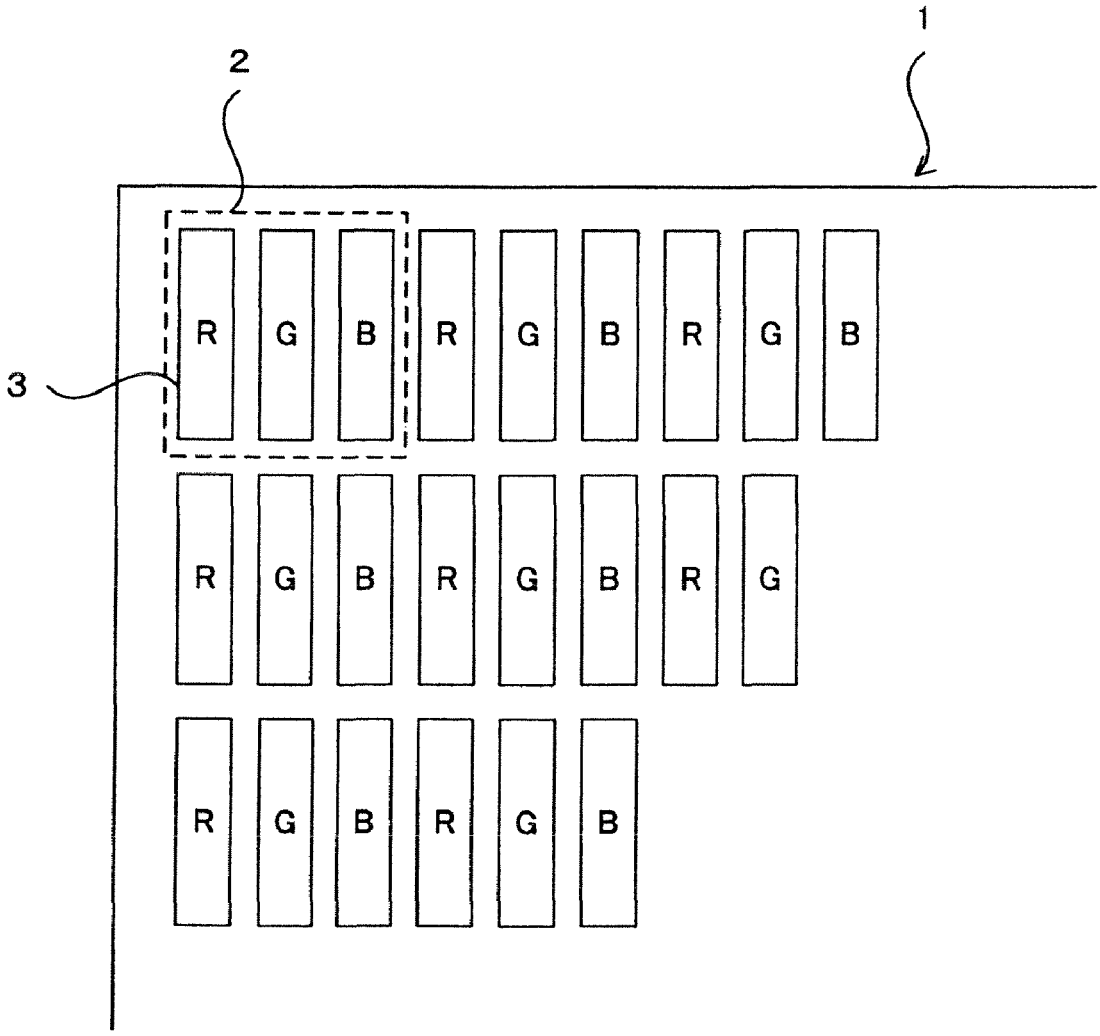
FIG. 1 is a diagram illustrating a configuration of a display device including R, G, and B sub-pixels.
Figure 2:
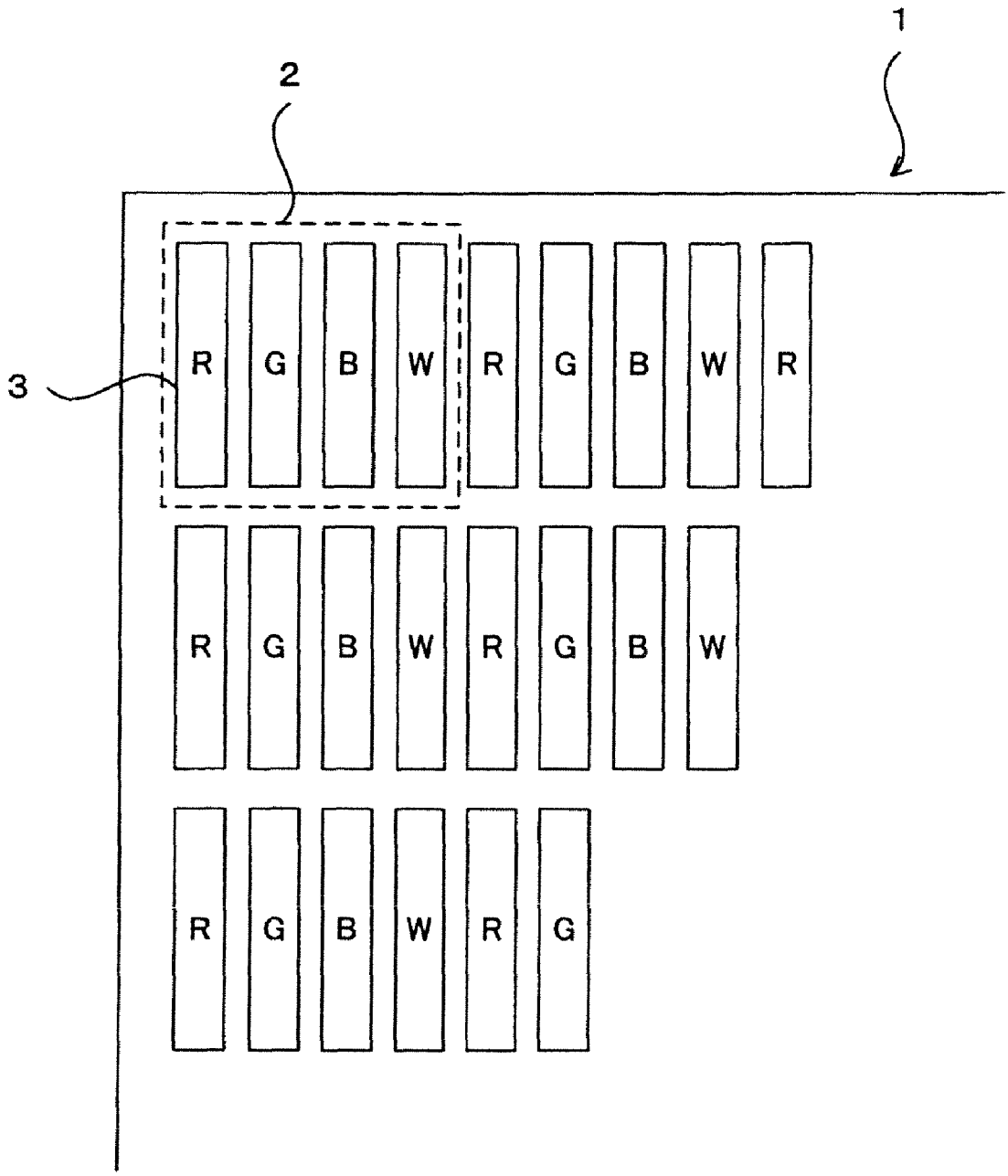
FIG. 2 is a diagram illustrating a configuration example of a display device including R, G, B, and W sub-pixels.
Figure 3:
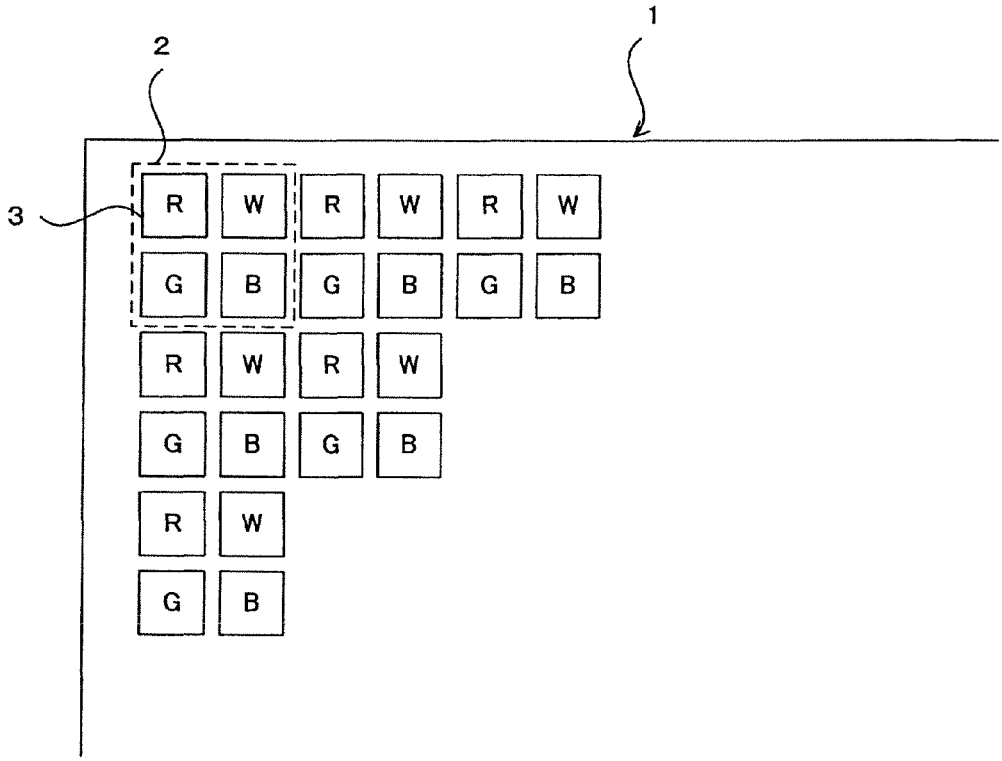
FIG. 3 is a diagram illustrating another configuration example of a display device including R, G, B, and W sub-pixels.
Figure 4:
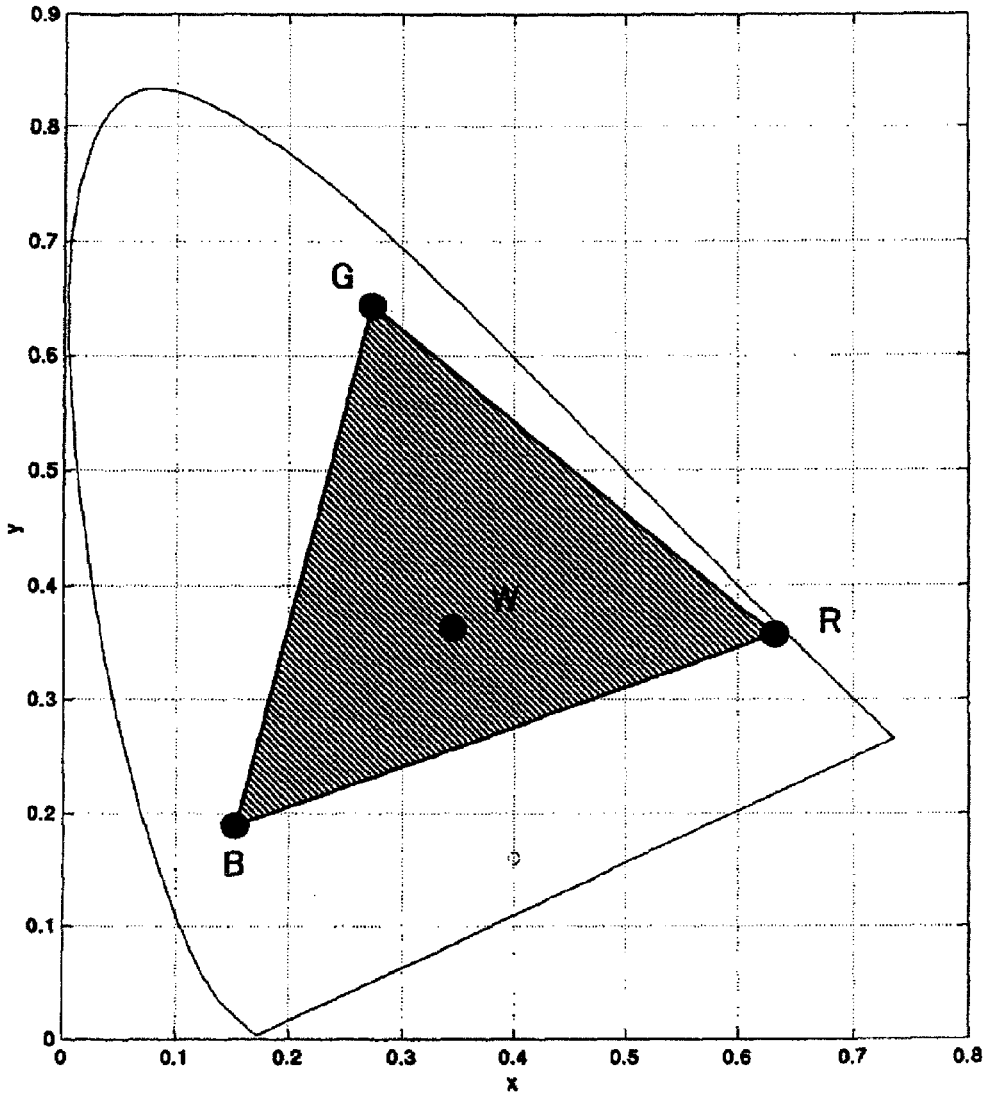
FIG. 4 is a CIE 1931 chromaticity diagram.
Figure 5:
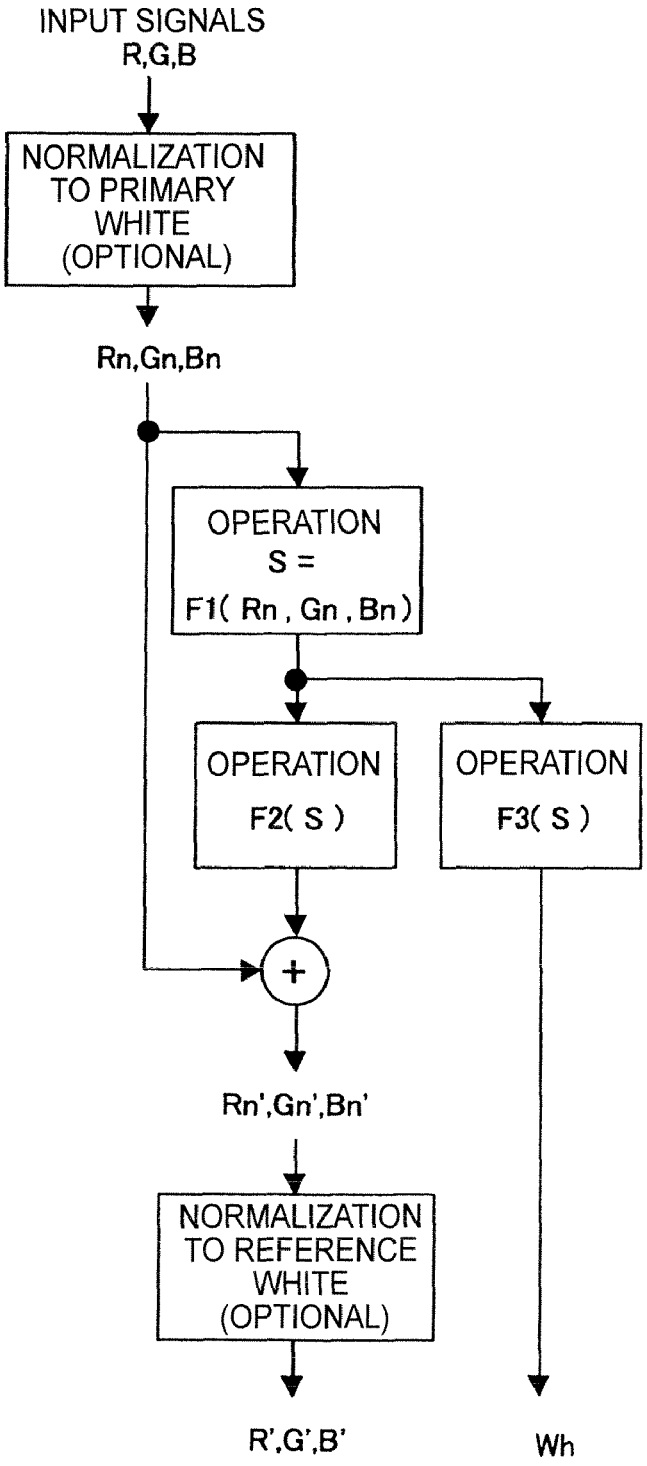
FIG. 5 is a diagram illustrating processing of conversion to RGBW.
Figure 6:
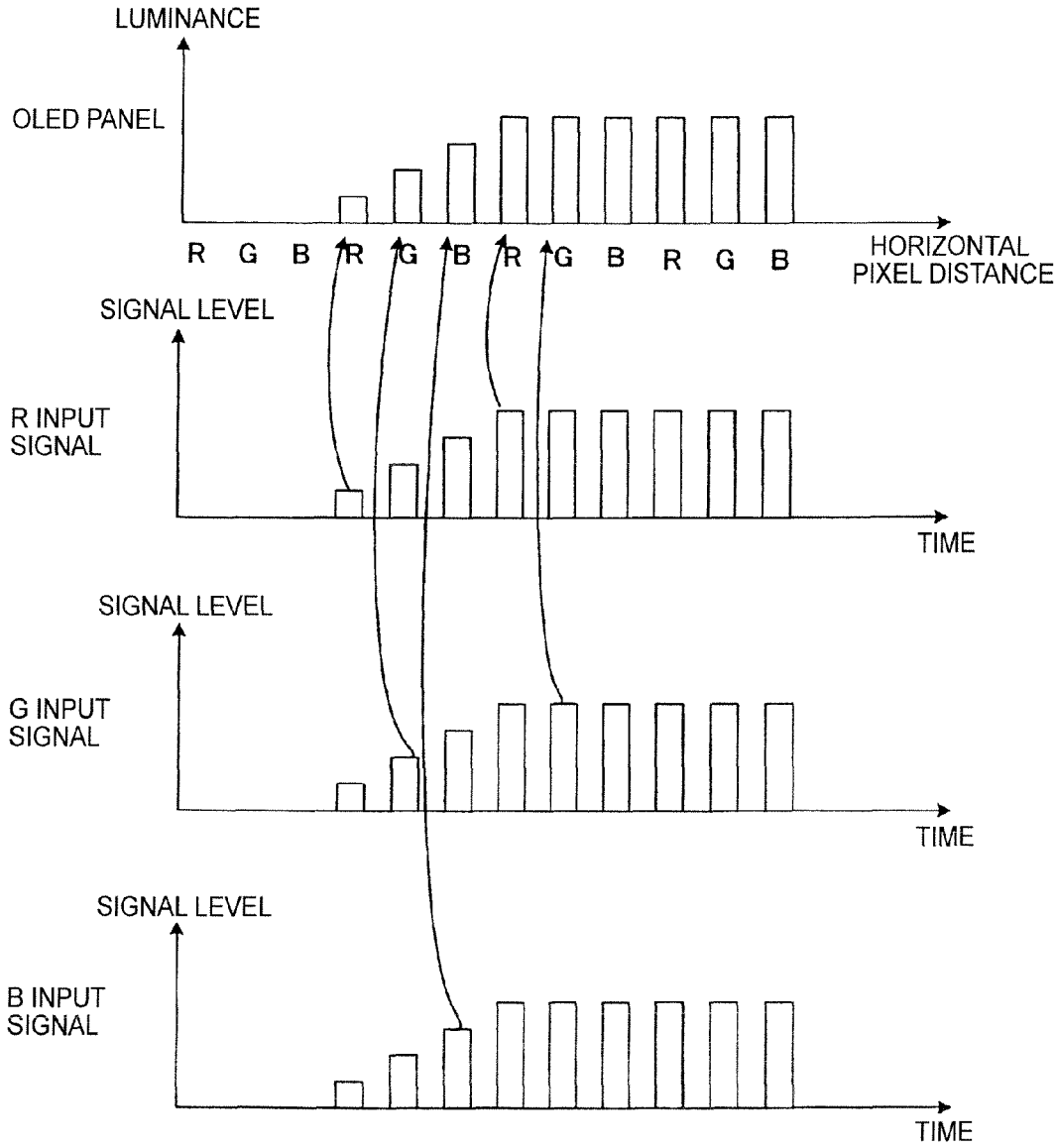
FIG. 6 is an explanatory diagram illustrating processing of aligning a phase of a signal of each color and a position of each sub-pixel in a panel.
Figure 7:
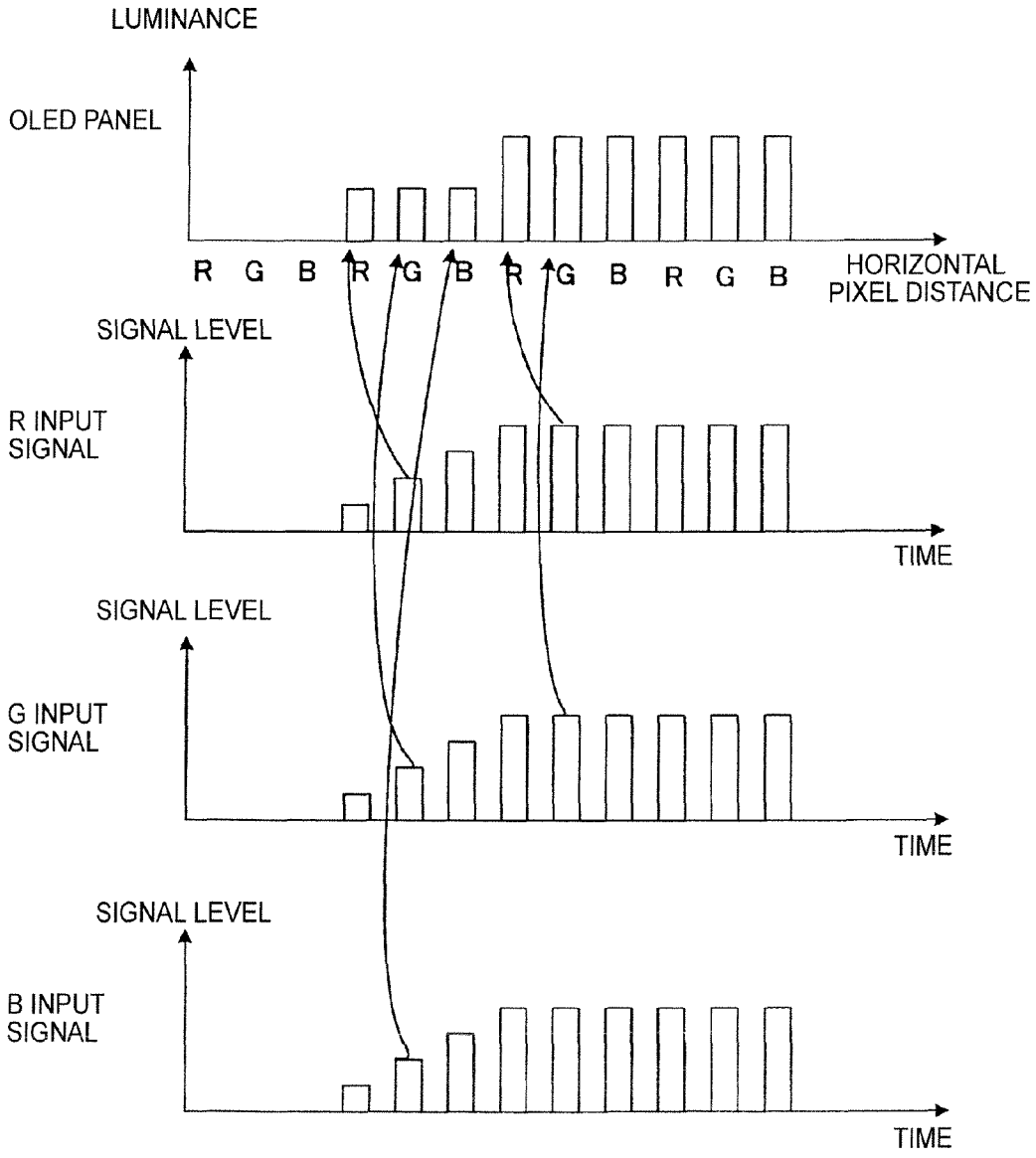
FIG. 7 is an explanatory diagram illustrating processing of aligning a phase of a signal of each color and a position of each sub-pixel in a panel.
Figure 8:
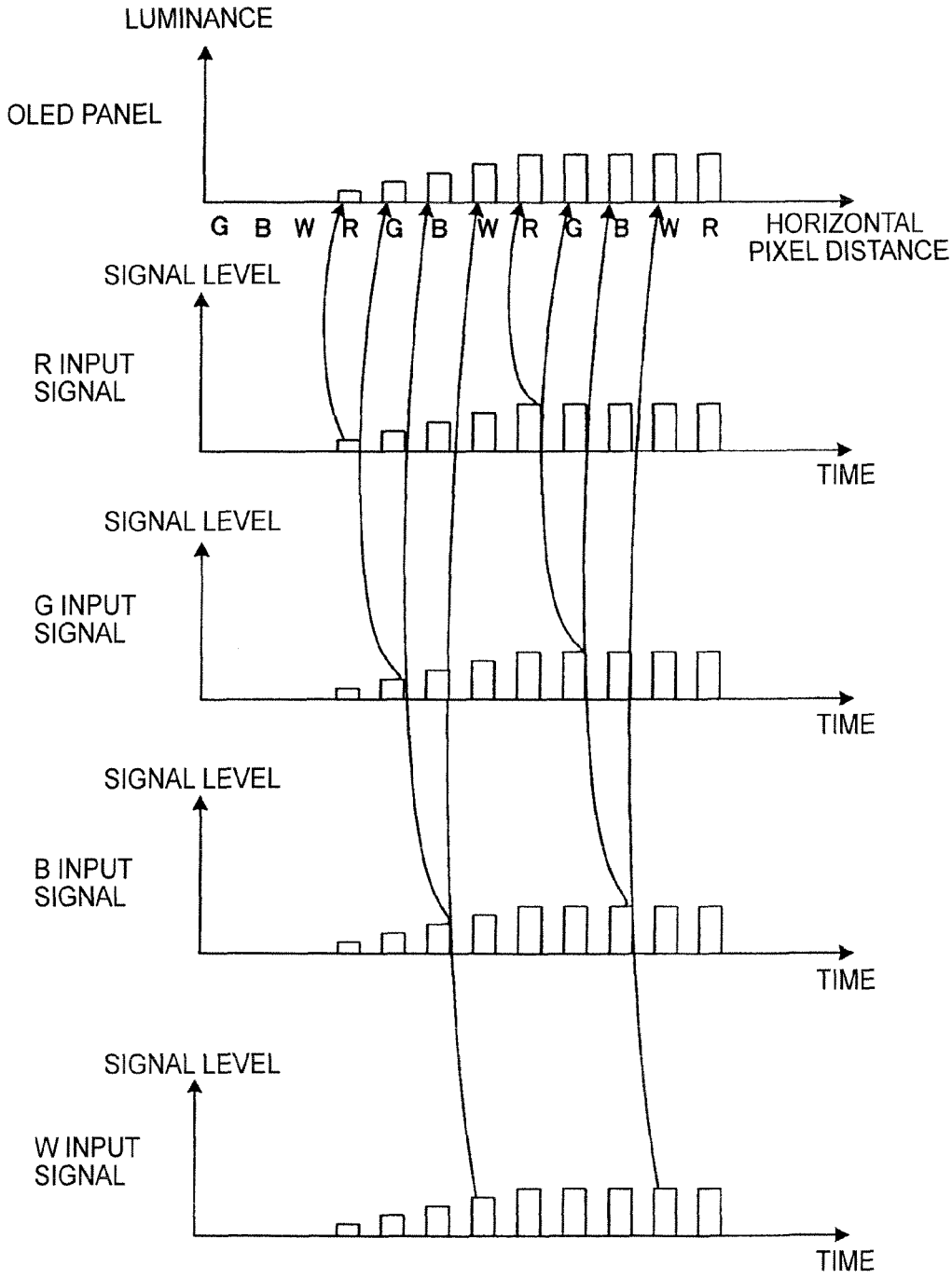
FIG. 8 is an explanatory diagram illustrating processing of aligning a phase of a signal of each color and a position of each sub-pixel in a panel.
Figure 9:
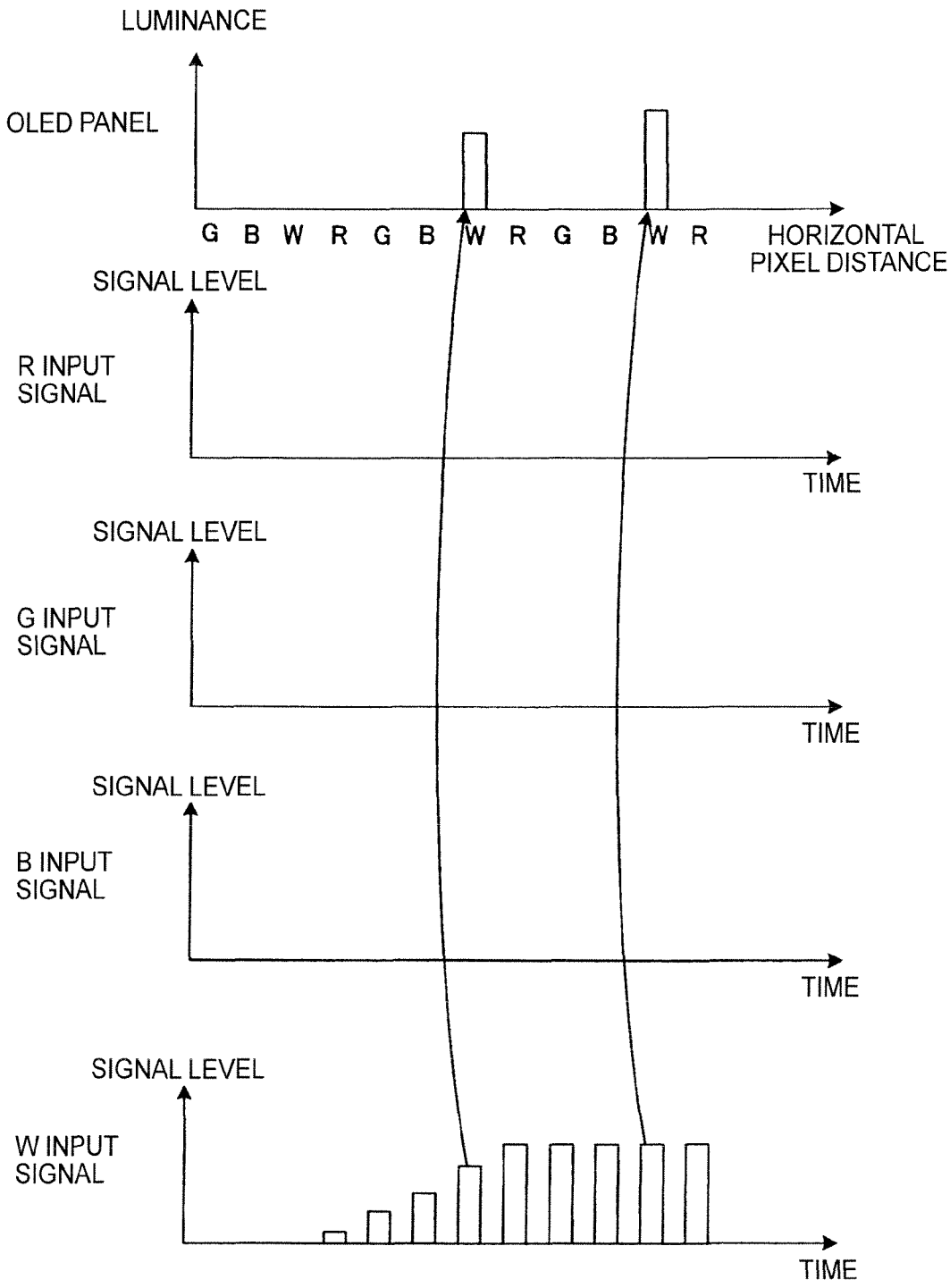
FIG. 9 is an explanatory diagram illustrating processing of aligning a phase of a signal of black and white and a position of each sub-pixel in a panel.
Figure 10:
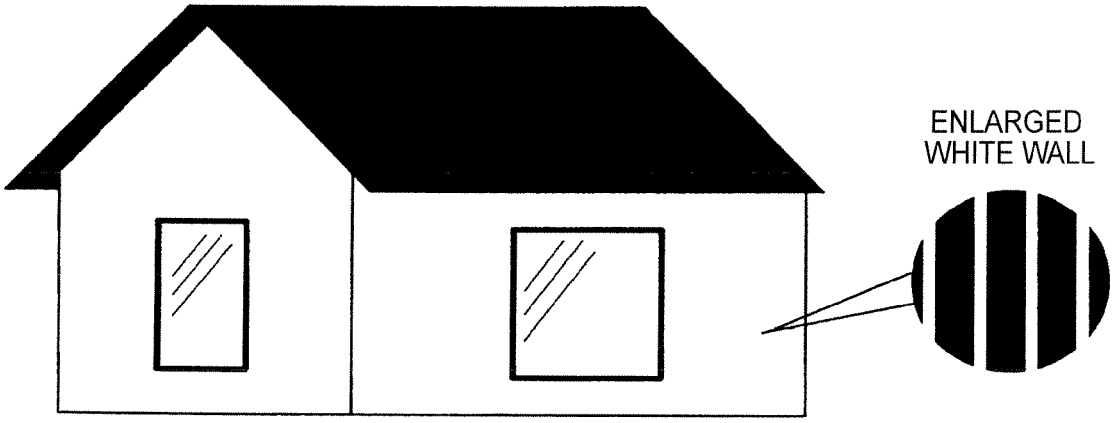
FIG. 10 is a diagram illustrating reduction in image quality.
Figure 11:
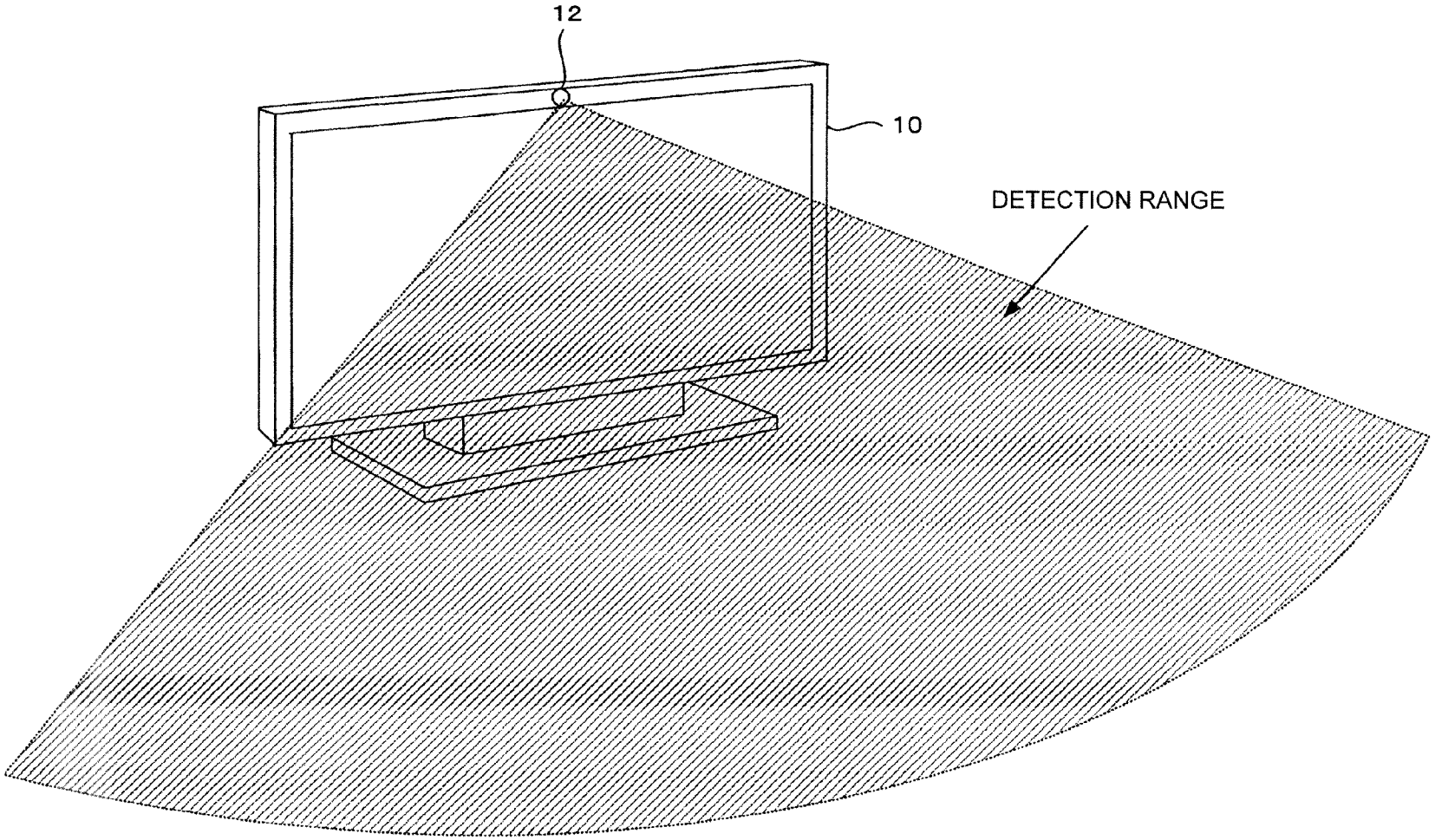
FIG. 11 is a diagram illustrating a configuration according to an embodiment.

FIG. 11 is a diagram illustrating external appearance of a display device (monitor) 10 according to the embodiment. The display device 10 includes a human detection sensor 12 for detecting the presence of a person. The human detection sensor 12 is used to detect the presence of a person viewing the display device 10.

Taking a 52-inch full hi-definition monitor (1,920×1,080 pixels) as an example, the height (H) of the screen is about 65 cm. Therefore, the above-mentioned viewing distance 3H at which the scanning line (pixel) cannot be distinguished is 195 cm, and hence the pixel may be distinguished when viewed within 2 m. In order to address this problem, the value of M in Equations 6 and 7 is set to, for example, 0.5 when a person is detected within 2 m by the human detection sensor 12, and to 1 otherwise so that sufficient image quality is maintained at all times while saving power depending on the usage.

The human detection sensor 12 may be, for example, an infrared motion sensor for capturing infrared rays emitted by a person and detecting slight movements of the person, to thereby detect a person in a predetermined range.

It is also preferred to use the technique described in Japanese Patent Application Laid-open No. 2006-003475 in combination. For example, the value of M is changed depending on spatial frequency components of the image when a person is within a predetermined distance, and M is set to 1 otherwise.

Further, when a human detection sensor capable of measuring the distance between the display device 10 and a person is equipped, the value of M may be changed gradually depending on the distance. Taking a full high-definition monitor with 1,080 scanning lines as an example, M is set to 0.5 when the distance is 3H or smaller, M is set to 1 when the distance is 5H or larger, and M is increased as the distance increases in the range of from 3H to 5H. The method of measuring the distance of the person may include, for example, providing a camera or the like and analyzing the image taken of the scene in front of the display device to estimate the presence and distance of a person.

Hereinabove, F2 and F3 have been described on the basis of Equations 6 and 7. Therefore, the luminance and chromaticity of a displayed image are reproduced faithfully in accordance with the input RGB.

However, this embodiment is also applicable to a case where the luminance and the chromaticity of the displayed image are different from those of the input image. In Japanese Patent Application Laid-open No. 2004-280108, the saturation of a color is changed depending on the use environment of the equipment in order to suppress power consumption. From the viewpoint that the luminance is more important than the saturation of a color in terms of visibility, W, which is high in emission efficiency, is emitted more brightly to such extent as to reduce the saturation of the color in bright surroundings. Therefore, the power consumption is prevented from being increased when the luminance is increased. When applied to the above-mentioned digital signage, the method described in Japanese Patent Application Laid-open No. 2004-280108 may be employed to increase the luminance while saving power when a person is not present within a predetermined range, and, when a person is present within the predetermined range, a method may be employed in which a predetermined luminance that allows comfortable viewing from a close distance is achieved and the use rate of the W sub-pixel is set to 50% to increase the visual resolution.

Figure 12:
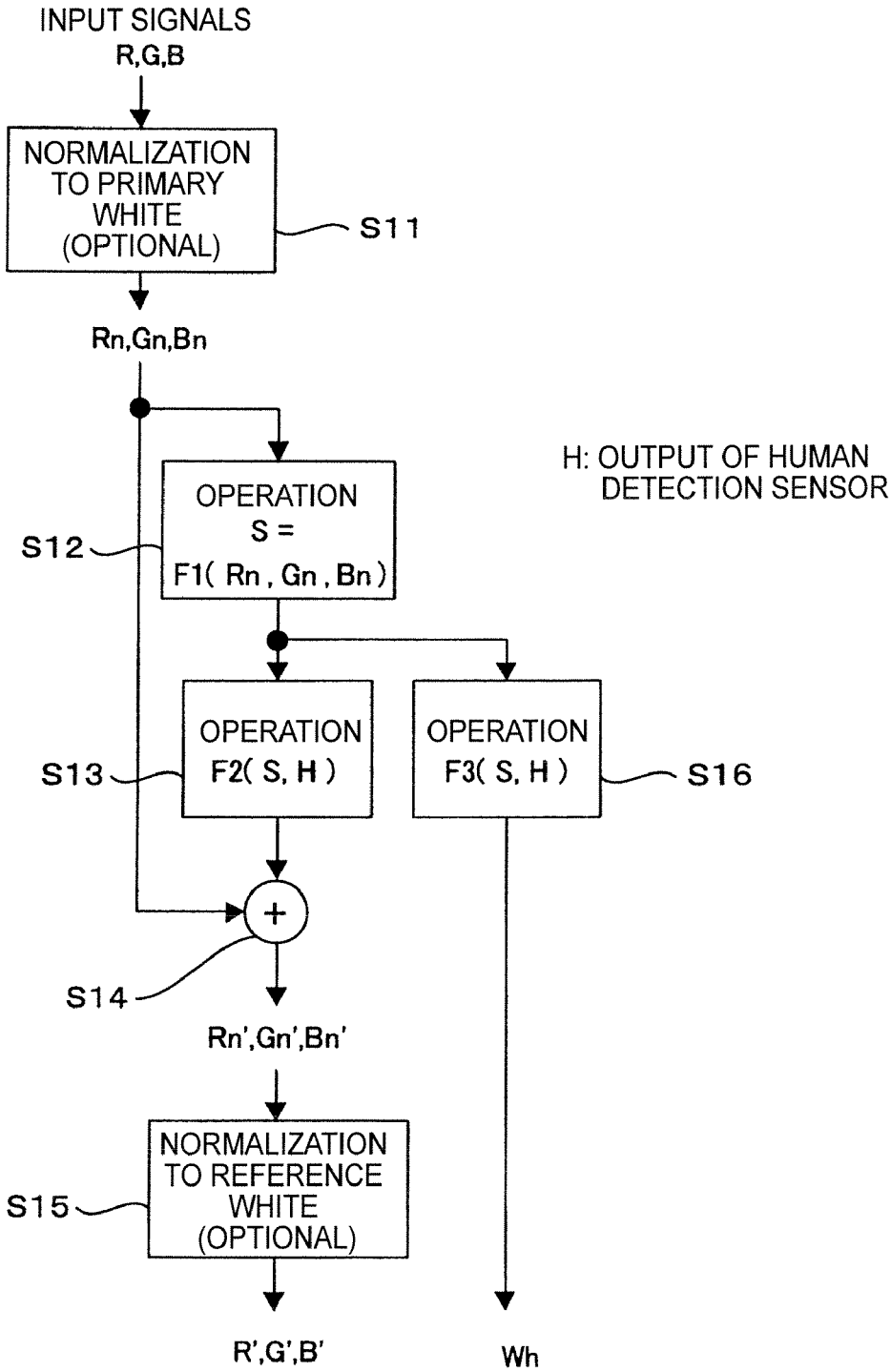
FIG. 12 is a diagram illustrating processing of conversion to RGBW according to the embodiment.

FIG. 12 illustrates a process of converting, in the display device 10 including the human detection sensor 12, R, G, and B input signals, with which the reference white of the display may be displayed when R=1, G=1, and B=1, to R, G, B, and W image signals. The operation expressed by Equation 1 is performed on the R, G, and B input signals for normalization to the primary white (S11). The normalized signals are denoted by Rn, Gn, and Bn. Note that, the normalization in S11 is not necessarily performed.

Next, for the signals Rn, Gn, and Bn, S corresponding to the luminance of W is calculated by the operation F1 (Rn, Gn, Bn) (S12). The operation F1 is, for example, an operation of selecting the minimum value as in Equation 2. Then, S is used to perform the operation F2(S, H) (S13). For example, using a human detection sensor that outputs H=1 when a person is present in a predetermined distance range and H=0 otherwise, the following equation is applied to set the value of M in Equation 6 to 0.5 when a person is present in the predetermined range and to 1 otherwise.

$$F2(S,H)=-(1-0.5H)S \qquad \text{Equation 8}$$

The obtained F2 (S, H) is added to Rn, Gn, and Bn (S14) to subtract the luminance corresponding to the luminance of the W sub-pixel from Rn, Gn, and Bn and hence obtain Rn', Gn', and Bn' (S14). If necessary, normalization to the reference white is performed (S15) to output the luminance R', G', and B' for each sub-pixel.

Meanwhile, S is also used to calculate F3(S, H) (S16). When F3 is an equation which is different only in sign from that of S13 described above as follows, the luminance and the chromaticity of the displayed image is reproduced faithfully in accordance with the input R, G, and B.

$$F3(S,H)=-(1-0.5H)S \qquad \text{Equation 9}$$

Then, the obtained F3 (S, H) is output as a luminance Wh of the sub-pixel W.

Figure 13:
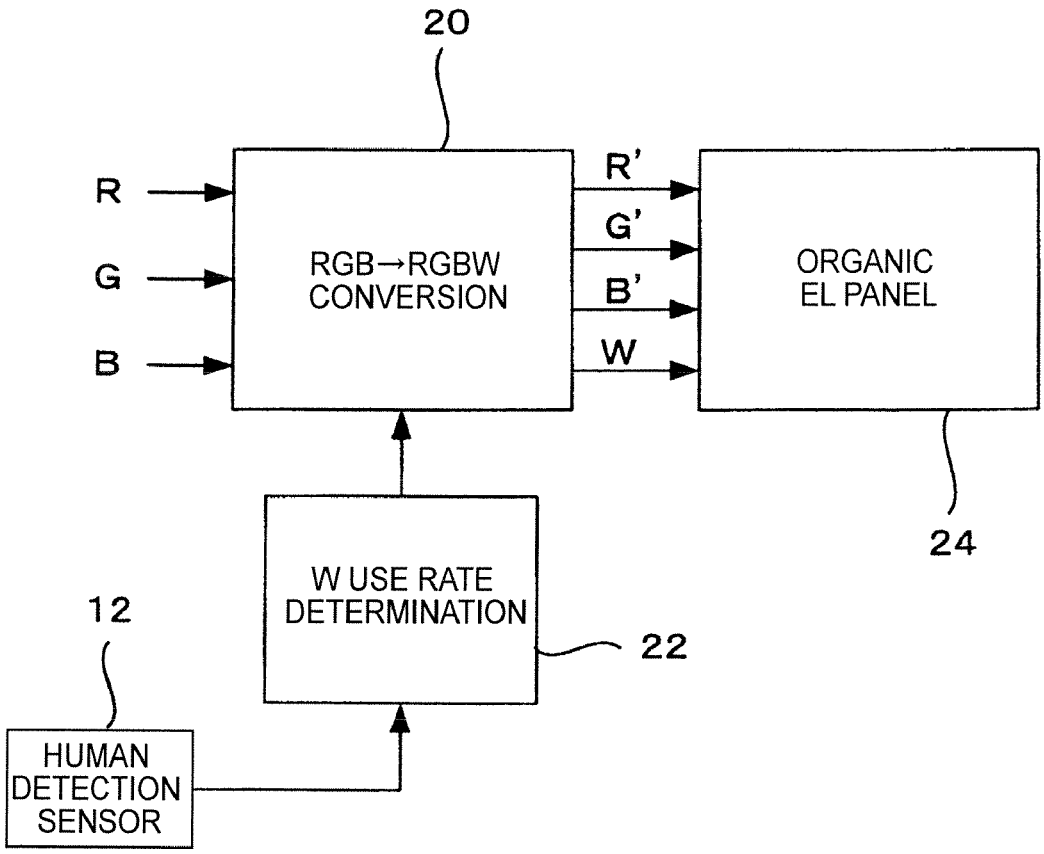
FIG. 13 is a diagram illustrating a configuration for conversion from RGB to RGBW.

FIG. 13 illustrates a configuration example of the display device. The image signals R, G, and B are input to an RGB-RGBW conversion section 20, and the operation as described above is performed to calculate R', G', B', and W. In this case, the RGB-RGBW conversion section 20 is supplied with a signal regarding the use rate of the W sub-pixel from a W use rate determination section 22. The W use rate determination section 22 outputs the signal regarding the use rate of the W sub-pixel depending on the signal from the human detection sensor 12. The use rate of the W sub-pixel is set to maximum when a person is not present in a predetermined distance range, and the use rate of the W sub-pixel is restricted when a person is present in the predetermined distance range. The RGB-RGBW conversion section 20 uses the use rate of the W sub-pixel corresponding to the signal from the W use rate determination section 22 to determine R', G', B', and W, and supplies the determined R', G', B', and W to an organic electroluminescence (EL) panel 24. Therefore, the use rate of the W sub-pixel is changed depending on the distance of the viewer in a range that causes no problem in the perceived image quality for display.

What is claimed is:

1. A display device, comprising:

pixels arranged in matrix, the pixels each including an R sub-pixel, a G sub-pixel, a B sub-pixel, and a W sub-pixel; and a human detection sensor for detecting a person around the display device, wherein a use rate of the W sub-pixel is changed depending on a result of the detection.

2. A display device according to claim 1, wherein:

the human detection sensor comprises a sensor for detecting whether or not a person is present within a predetermined range from the display device; and the display device changes the use rate of the W sub-pixel depending on whether or not a person is present within the predetermined range.

3. A display device according to claim 1, wherein:

the human detection sensor comprises a sensor for measuring a distance of a person located closest to the display device; and the display device changes the use rate of the W sub-pixel depending on the measured distance.

* * * * *